US007229367B2

(12) United States Patent
Baker et al.

(10) Patent No.: US 7,229,367 B2
(45) Date of Patent: Jun. 12, 2007

(54) QUICK CONNECT BASKETBALL PRACTICE DEVICE

(75) Inventors: Adrian Baker, Litchfield, IL (US); Michael Joe Rivali, Litchfield, IL (US)

(73) Assignee: HOS Development Corporation, Litchfield, IL (US)

( * ) Notice: Subject to any disclaimer, the term of this patent is extended or adjusted under 35 U.S.C. 154(b) by 48 days.

(21) Appl. No.: 10/915,822

(22) Filed: Aug. 11, 2004

(65) Prior Publication Data

US 2006/0035735 A1 Feb. 16, 2006

(51) Int. Cl.
*A63B 69/00* (2006.01)

(52) U.S. Cl. ..... 473/448; D21/781

(58) Field of Classification Search ..... 473/448, 473/485, 449, 470, 447, 472, 476, 489; 273/317.3; 24/27, 270, 122.6, 328
See application file for complete search history.

(56) References Cited

U.S. PATENT DOCUMENTS 1,531,770 A * 3/1925 Walker ..... 24/116 R
1,566,466 A * 12/1925 Cleaver ..... 24/300
1,904,836 A 4/1933 Peoples
1,907,836 A * 5/1933 Lauterbur et al. ..... 366/91
2,708,576 A * 5/1955 Verkuilen ..... 473/448
2,918,283 A 12/1959 Marschalk
3,348,840 A * 10/1967 Dix ..... 473/449
3,383,738 A * 5/1968 Fox et al. ..... 24/306
3,427,026 A * 2/1969 Mahoney ..... 473/435
3,751,769 A * 8/1973 Reiner ..... 24/300
5,207,789 A * 5/1993 Gates ..... 473/448
5,364,092 A 11/1994 Riepe et al.
5,665,016 A 9/1997 Burnett
5,738,600 A 4/1998 Fouts et al.
5,823,896 A 10/1998 Pearsall
6,056,652 A 5/2000 Lees et al.
6,145,170 A * 11/2000 Bernard et al. ..... 24/298
6,298,524 B1 * 10/2001 Officer ..... 24/306
6,389,659 B1 * 5/2002 Jacobs ..... 24/573.09
6,652,396 B2 11/2003 McBride
2004/0043841 A1 * 3/2004 Williams ..... 473/448

* cited by examiner

*Primary Examiner*—Eugene Kim
*Assistant Examiner*—M. Chambers
(74) *Attorney, Agent, or Firm*—Michael Best & Friedrich LLP

(57) ABSTRACT

A basketball practice device is for use with a basketball rim having a diameter. The practice device includes an annular body, the body having a diameter substantially lesser than the rim diameter, and at least one and preferably a plurality of supports. Each support is connected with the annular body and has a mount disposeable upon a portion of the rim. At least one and preferably a plurality of retainers each have a first end connected with the support, a second end releasably connected with the support, and a central section. Each central section is extendable at least partially about the rim portion such that the rim portion is retained between the support mount and the retainer to connect the practice device with the rim. Further, each retainer includes a generally elastic loop providing the ends and central portion and is extendable to engage with and disengage from the support.

17 Claims, 5 Drawing Sheets

QUICK CONNECT BASKETBALL PRACTICE DEVICE

BACKGROUND OF THE INVENTION

The present invention relates to basketball equipment, and more particularly to devices for improving basketball skills.

Devices for practicing basketball shooting or rebounding skills have been previously known. Typically, such devices include a rim or hoop mountable to a basketball rim and having a diameter that is lesser than the diameter of a conventional basketball rim. As such, these devices are used to hone either shooting or rebounding skills.

SUMMARY OF THE INVENTION

In one aspect, the present invention is a basketball practice device for use with a basketball rim. The practice device comprises an annular body and a support connected with the annular body and having a mount disposeable upon a portion of the rim. A retainer has first end connected with the support, a second end releasably connected with the support, and a central section. The central section is extendable at least partially about the rim portion such that the rim portion is retained generally between the support mount and the retainer to connect the practice device with the rim.

In another aspect, the present invention is a connector for retaining a practice device on a basketball rim. The practice device includes an annular body and at least one support attached to the body and having an end disposeable upon the rim. The connector comprises a retainer having a flexible body with a first end connected with the support, a second end releasably connected with the support, and a central section. The central section is extendable at least partially about a portion of the rim such that the rim portion is retained generally between the support and the retainer body to connect the practice device with the rim.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
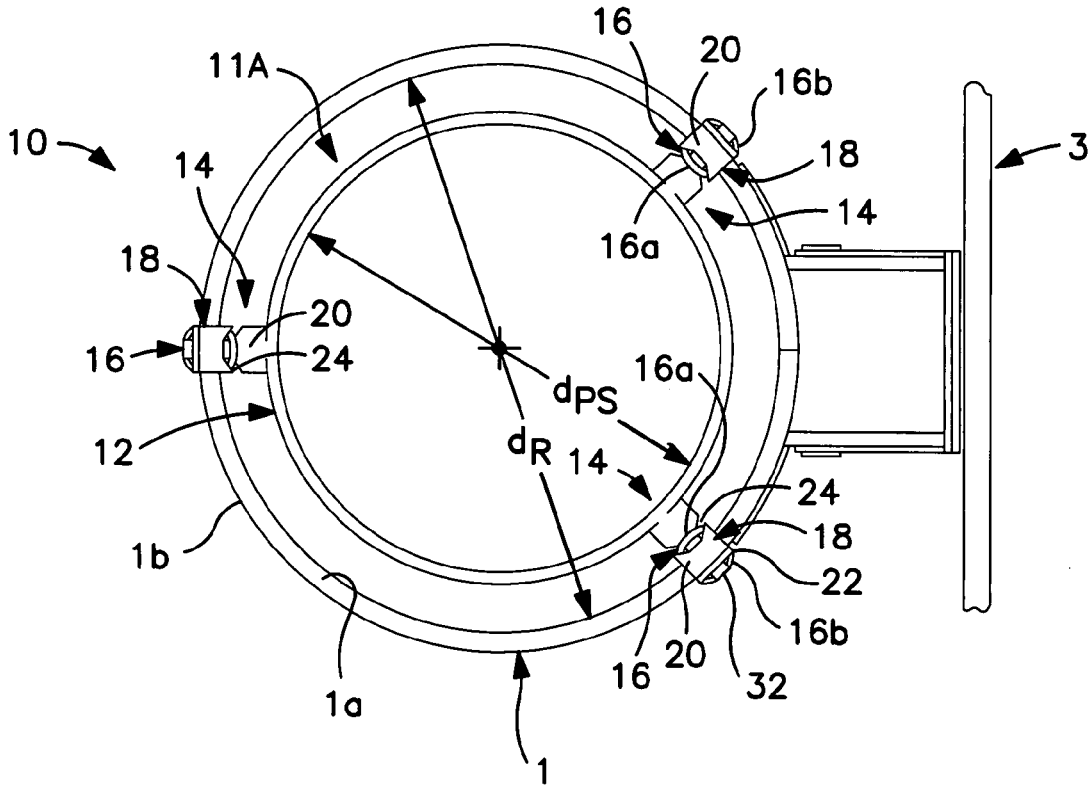
FIG. 1 is a top plan view of a practice device in accordance with the present invention, shown as a first, shot ring construction and mounted to a basketball rim.

Certain terminology is used in the following description for convenience only and is not limiting. The words "lower", "upper", and "upward" designate directions in the drawings to which reference is made. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Referring now to the drawings in detail, wherein like numbers are used to indicate like elements throughout, there is shown in FIGS. 1-10 a presently preferred embodiment of a basketball practice device 10 for use with a basketball rim 1, the rim 1 having a central axis $A_R$, a diameter $d_R$, an upper surface 1*a* and an outer circumferential surface 1*b*. The practice device 10 basically comprises an annular body 12 with a central axis $A_B$, at least one and preferably three supports 14 each connected with the body 12, and at least one and preferably three connectors or retainers 16 each connected with a separate support 14. The annular body 12 has a diameter $d_P$ that is substantially lesser than the rim diameter dR such that the body functions as either a shooting practice device 11A (FIGS. 1, 2 and 5) or alternatively as a rebound practice device 11B (FIGS. 3, 4 and 6), as discussed in detail below. The supports 14 each have an inner end 14*a* attached to the rim 2 and an outer end 14*b* providing a mount 18 disposeable upon a separate section or portion 2 of the rim 1. Further, the supports 14 are spaced circumferentially about the annular body 12, most preferably about 120° apart for the preferred three supports 14.

Furthermore, each retainer 16 has a first end 16*a* connected with the support 14, a second end 16*b* releasably connected with the support 14, and a central section 17. Although the first end 16*a* of each retainer 16 is preferably fixedly connected with support 14, the retainer first ends 16*a* may also be releasably connectable with the supports 14. Further, the retainer central section 17 is extendable at least partially about the proximal rim portion 2 when both ends 16*a*, 16*b* are connected with the support 14. As such, the rim portion 2 is retained generally between the support mount 18 and the retainer 16 to thereby connect the practice device 10 with the rim 1. Preferably, each retainer central section 17 contacts the rim portion 2, or a bracer plate 5 (discussed below), such that the portion 2 (and plate 5) is generally sandwiched between the mount 18 and the retainer section 17. Alternatively, the retainer central section 17 may be spaced from the rim portion 2 such that the portion 2 is merely disposed or "trapped" between the mount 18 and retainer 16.

Preferably, the support mounts 18 each include a first, generally horizontal (i.e., when connected with the rim 1)

section 20 disposeable upon the rim upper surface 1*a* and a second, generally vertical section 22. Each mount second section 22 extends generally perpendicularly with respect to the first section 20 and is disposeable generally along the rim outer circumferential surface 1*b*. Furthermore, each support mount section 20, 22 has at least one and preferably two openings 24 configured to receive a separate one of the retainer first and second ends 16*a*, 16*b*, as discussed in greater detail below.

Referring to FIGS. 7-10, each retainer 16 preferably includes a generally elastic body 26 providing the retainer first and second ends 16*a*, 16*b* and the central portion 17. The retainer elastic body 26 is configured to extend to engage the retainer second end 16*b* with the support 14 and alternatively to disengage the retainer second end 16*b* from the support 14. That is, the retainer body 26 is normally in a free or unstretched state when the second end 16*b* is not connected with the support 14 (FIG. 9) and extends or deflects by application of a force, as discussed below, to engage the second end 16*b* with the support 14 (see, e.g., FIG. 10). As such, the retainer body 26 is in tension when the two retainer body ends 16*a*, 16*b* are each connected with the support 14, which serves to pull the mount 18 of the associated support 14 against the rim portion 2.

Most preferably, the retainer elastic body 26 is formed as a generally enclosed loop 28. As such, each retainer end 16*a*, 16*b* has two connective portions 29 disposed in a separate mount opening 24 and the retainer central section 17 includes two generally parallel retainer portions 30 extendable about the rim portion 2, and in some cases, also about a portion of a bracer plate 5, as discussed below. However, the elastic body 26 may alternatively be provided by an elongated member or cable (not shown) having two opposing, free ends each connected or connectable with a separate section of the associated support 14. As a further alternative, each retainer 16 may be formed as a rigid member (e.g., a bar or plate, none shown) having two ends connected or connectable with the associated support 14 and having a central section extendable about a rim portion 2.

Furthermore, each retainer 16 preferably includes a handle or grip member 32 connected with the elastic body 26 and configured to be graspable by a user to manually extend the body 26, specifically to displace the retainer second end 16*b* into or out of engagement with the support 14. Preferably each grip member 32 is formed as a generally circular cylinder 34 having a central opening 36, a portion of the body 26 extending through the disk opening 36 to secure the member 32 thereto. However, the grip member 32 may be formed in any appropriate manner (e.g., as a ring, tab, bar, etc.) or the retainers 16 may be constructed without any grip member or similar device.

With the basic practice device structure as described above, when it is desired to use the practice device 10 to improve a user's shooting or rebounding skills (as described in further detail below), the user places the practice device 10 upon the rim upper surface 1*a*, with at least one end (e.g., 16*b*) of each retainer 16 being disconnected from the associated support 14, such that each support mount 18 is disposed on a separate rim portion 2. Then, one or both retainer ends 16*a*, 16*b* (if both are disconnected) of each retainer 16 is/are connected with the associated supports 14 to retain the proximal rim portion 2 between the retainer central section 17 and the support mount 18. The mounted practice device 10 is then ready for use, and when it is desired to demount or remove the device 10 from the rim 1, the user merely disconnects one end (e.g., 16*b*) of each retainer 16 from the associated support 14, and then lifts the device 10 from the rim 1. Having described the basic structural elements and operation, these and other components of the basketball practice device 10 are discussed in greater detail below.

Figure 2:
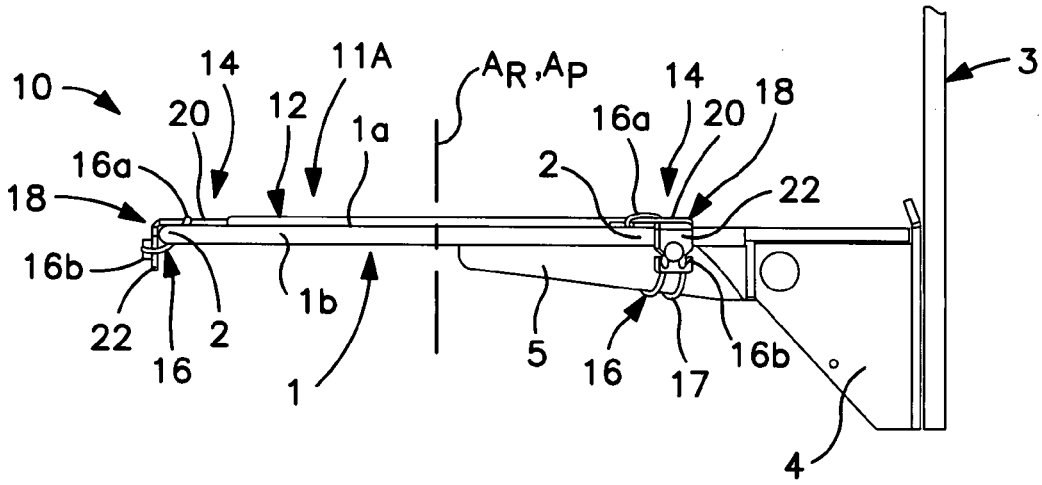
FIG. 2 is a side plan view of the practice device shown in FIG. 1.
Figure 3:
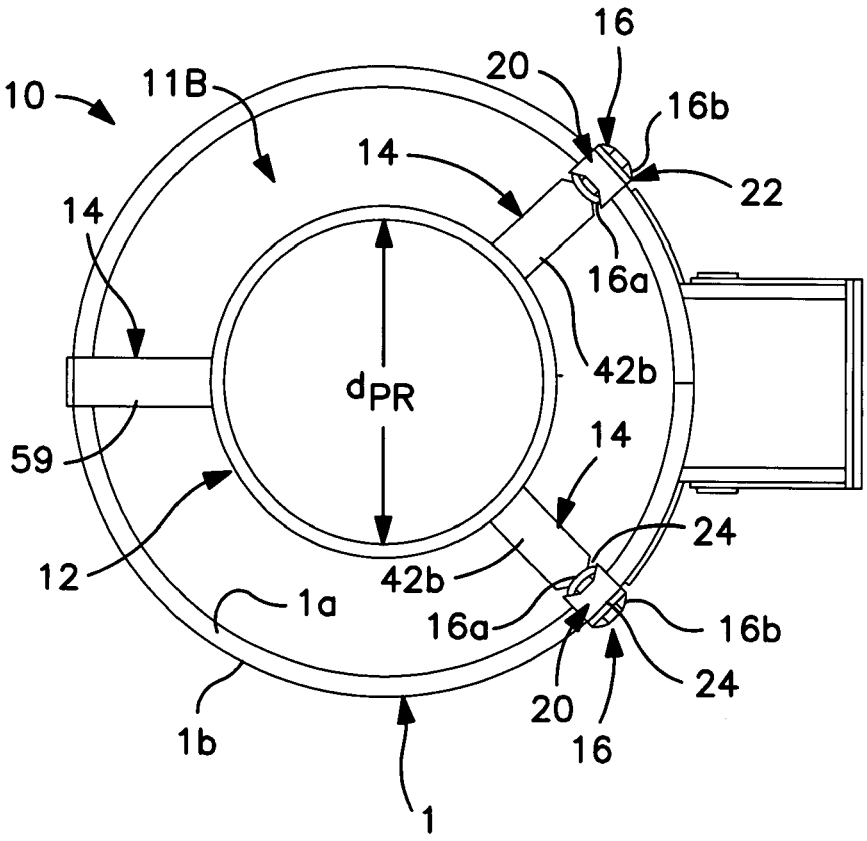
FIG. 3 is a top plan view of the practice device, shown as a second, rebound ring construction and mounted to a basketball rim.
Figure 4:
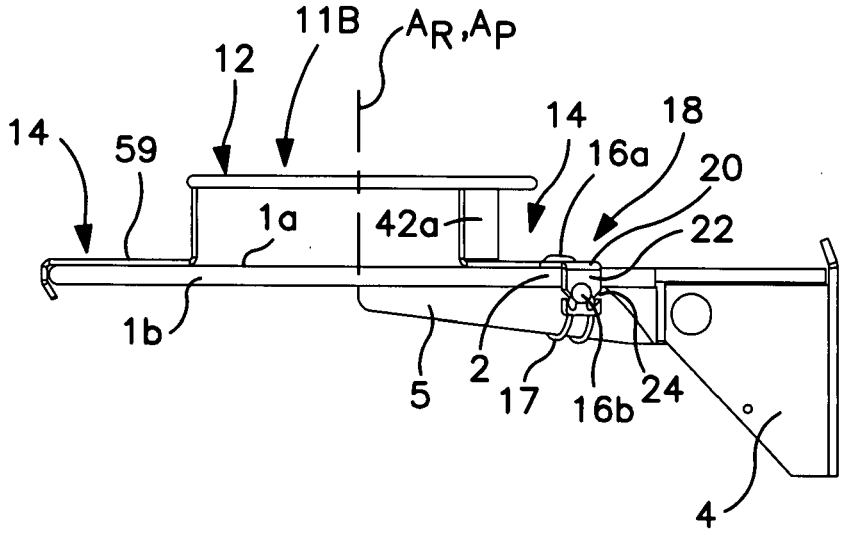
FIG. 4 is a side plan view of the practice device shown in FIG. 3.

Referring first to FIGS. 1-4, the practice device 10 of the present invention is preferably used with a conventional basketball rim 1. Such a basketball rim 1 is preferably attached to a mounting bracket 4 used to mount the rim 1 to a backboard 3 or to any other wall surface, such as a wall of a garage, home, school, etc. The rim 1 may include a bracer bar (not shown) or a bracer plate 5, as shown in FIGS. 2 and 4, that is configured to prevent bending of the rim 1 with respect to the bracket 4.

Referring now to FIGS. 1-6, as discussed above, the practice device 10 is preferably formed in either a first "shot ring" construction 11A, in which the practice device 10 is used to practice basketball shooting technique, or in a second "rebound ring" construction 11B in which the practice device 10 is used to practice basketball rebounding technique. More specifically, the annular body 12 of the shot ring construction 11A has a relatively larger diameter $d_{PS}$ (i.e., compared with the rebound ring 11B, but lesser than the rim diameter $d_R$) and is generally centered within the rim 1, such that the axes $A_R$, $A_P$ are generally coaxial, when the practice device 10 is mounted thereto. Each support 14 of the shot ring 11A has a body 40 that extends generally horizontally between the inner end 14*a* and the mount 18, such that the annular body 12 lies generally within a common horizontal plane (not indicated) with the basketball rim 1. Further, the shot ring diameter $d_{PS}$ is sized to permit a basketball to pass through the annular body 12, but with much less clearance than is provided by the rim 1. As such, more accuracy is required to successfully "make a shot" with a basketball, so that a person practicing with the shot ring 11A should increase their basketball shooting ability.

Figure 6:
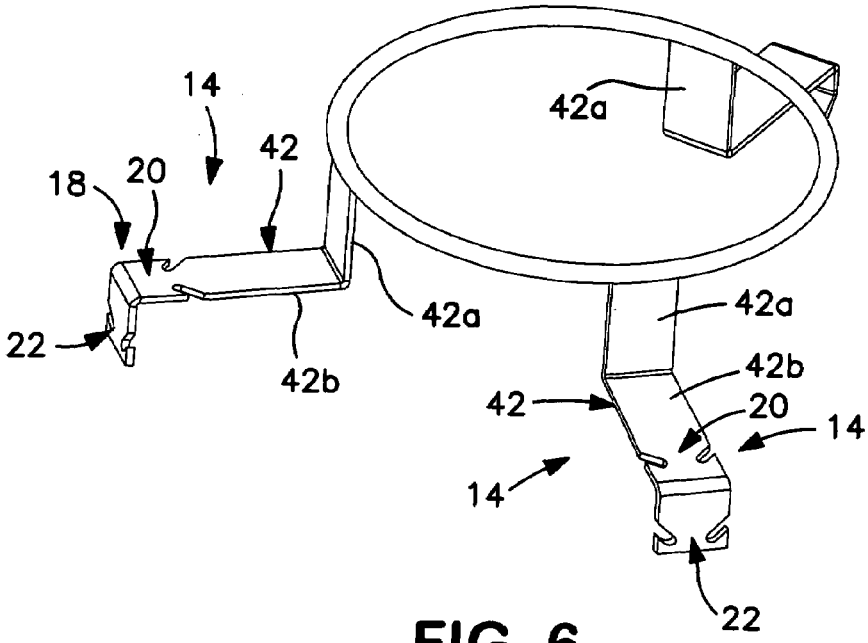
FIG. 6 is a perspective view of the rebound ring construction of FIGS. 3 and 4, shown without retainers.
Figure 7:
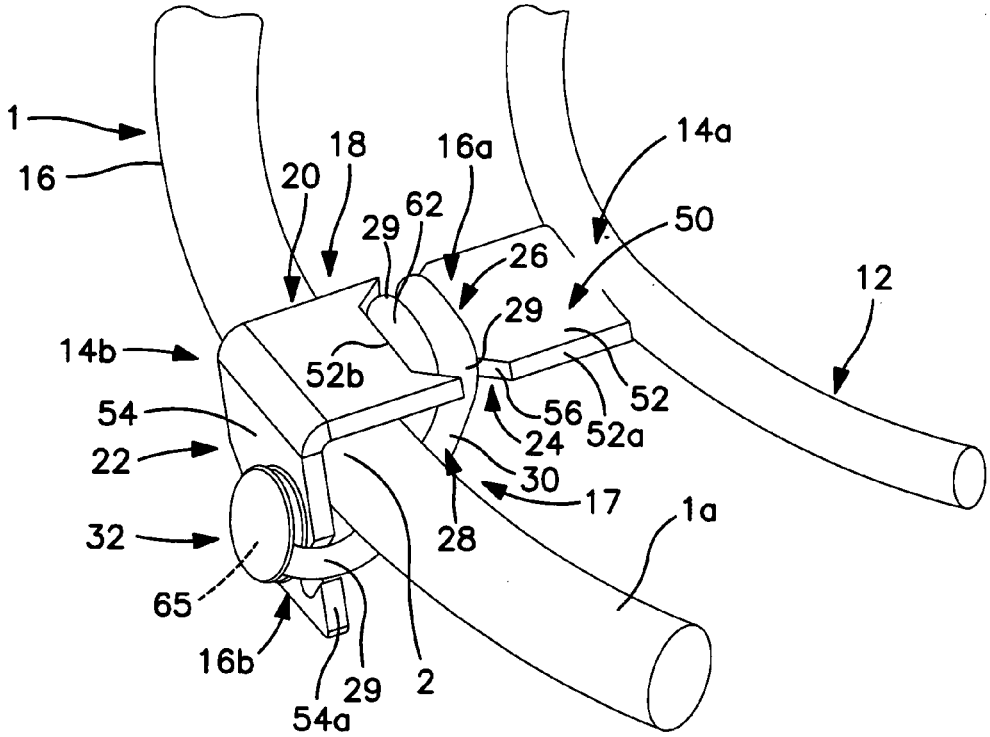
FIG. 7 is a broken-away, enlarged top perspective view of a support and retainer shown engaged with a rim.
Figure 8:
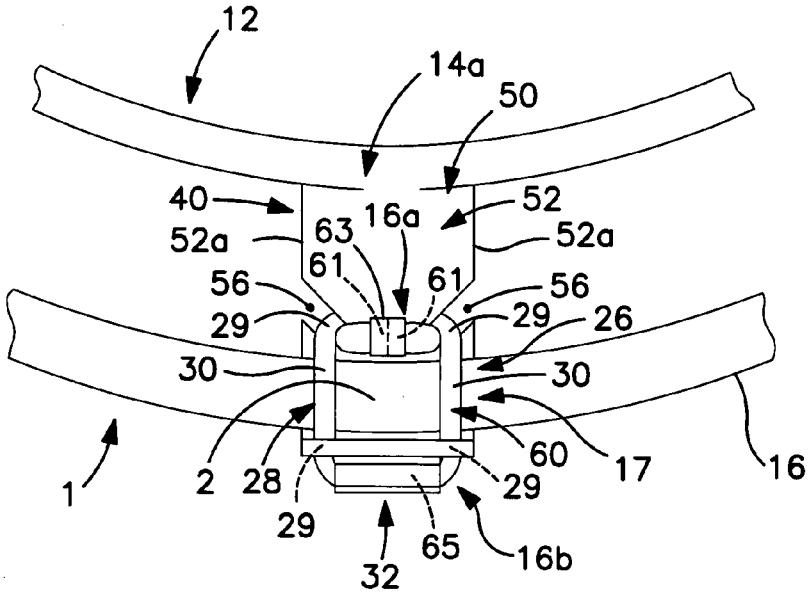
FIG. 8 is a broken-away, enlarged bottom perspective view of a support and retainer shown engaged with a rim.

Referring to FIGS. 3, 4 and 6, the annular body 12 of the rebound ring construction 11B has a relatively lesser diameter $d_{PR}$ (i.e., lesser than the rim and shot ring diameters $d_R$, $d_{PS}$) and is generally centered with respect to (i.e., coaxial), but spaced vertically above, the rim 1 when the practice device 10 is mounted thereto. More specifically, each support 14 of the rebound ring 11B has a "double bended", angled body 42 with an inner portion 42*a* attached to the annular body 12 and an outer portion 42*b* extending generally perpendicularly with respect to the inner portion 42*a* and disposeable upon the rim 1. As such, when the support mounts 18 are disposed on the rim 1, the outer portion 42*b* of each support body 42 extends generally horizontally and the inner portion 42*a* extends generally vertically and upwardly from the inner end of the outer portion 42*b*. Further, the rebound ring diameter $d_{PR}$ is sized to prevent a basketball from passing therethrough, such that a basketball contacting or impacting the rebound ring body 12 will bounce or rebound off of the body 12, simulating a rebounded shot in a basketball game. As such, a person using the rebound ring 11B to "shoot baskets" with a basketball should increase their ability to catch or make a basketball rebound.

Figure 5:
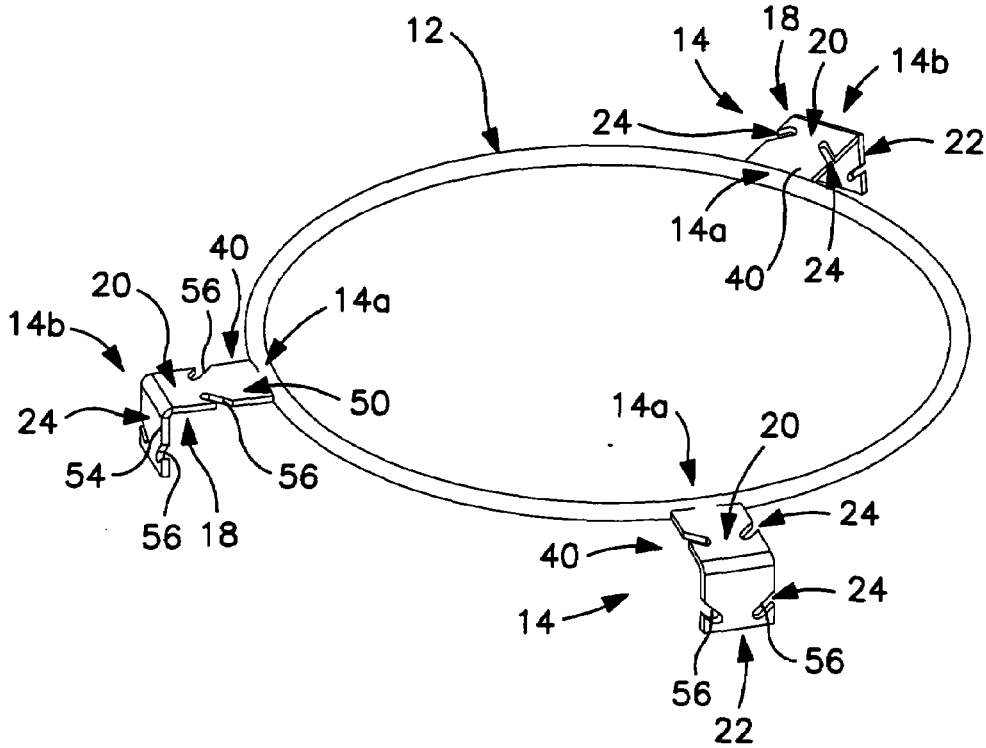
FIG. 5 is a perspective view of the shot ring construction of FIGS. 1 and 2, shown without retainers.

Referring to FIGS. 5 and 6, each support 14 preferably includes an angled plate 50 with a first plate portion 52 attached to the rim 1 and providing the mount first section 22 and a second plate portion 54 integrally formed with the first portion and providing the mount second section 24. With the shot ring construction 11A, the plate first portion 52 is generally flat and horizontal, whereas the first plate portion 52 of the rebound ring 11B is angled and includes the vertical and horizontal portions 42*a*, 42*b* described above.

Preferably, each one of the plate first and second portions 52, 54 has two opposing side edges 52*a*, 54*a* and two slotted openings 56 each extending into the plate portion from a separate one of the two side edges 52*a*, 54*a*. The two slotted openings 56 of each plate portion 52, 54 are configured to receive a separate one of the retainer first and second ends 16*a*, 16*b*, respectively, so as to releasably connect the retainer 16 with the support 14, as discussed in greater detail below.

Preferably, each opening 56 extends from one side edge 52*a* or 54*a* so as to be angled generally toward the support outer end 14*b*, such that each pair of openings 56 on each plate portion 52, 54 have a generally "V-like" appearance. As such, the openings 56 on the plate first portion 52 are configured to prevent disengagement of the retainer first end 16*a*, particularly during extension of the retainer 16 when engaging the second end 16*b* with the support 14, while the configuration of the openings 56 in the plate second portion 54 facilitate engagement and/or prevent disengagement of the retainer second end 16*b* with the support 14. However, the openings 56 may have any appropriate configuration, such as extending substantially laterally across the corresponding plate portion, generally circular and disposed more centrally on the plate portions 52, 54, etc., depending on the particular structure of the retainer 16.

Further, each support 14 preferably further includes a cushioning pad 58 attached to the lower surface 22*a* of the support mount first section 22 and disposeable upon the upper surface section 2*a* of rim portion 2 when the support 14 is mounted on the rim 1. The pads 58 are configured to reduce vibration of the practice device 10 arising from impacts from a basketball and to prevent metal-to-metal contact between the device 10 and the rim 1, which may scratch or otherwise mar the finish (e.g., paint) of the rim 1 or practice device 10. Preferably, each pad 58 is provided by a generally rectangular piece of rubber foam, but may be otherwise formed as appropriate.

Although the supports 14 are preferably constructed as described above, the supports 14 may each be formed having any other appropriate structure that is mountable on the rim 1 and engageable by the two ends 16*a*, 16*b* of the retainer 16. For example, the supports 14 may each be formed with only the horizontal mount section 20 and without the vertical mount section 22, such that the retainer 16 wraps about the rim portion 2 and both ends 16*a*, 16*b* engage with the horizontal section 20, or may include two vertical sections (not shown) which straddle the rim portion 2. Further for example, one or more of the supports 14 may be formed as a hook member 59 without any openings 56 and that is not engaged by a retainer 16, which functions by merely hooking about a rim portion 2, as depicted in FIG. 4. Furthermore, the practice device 10 may be formed with only two supports 14 (FIGS. 3 and 4) or with four or more supports 14 (not depicted), with a corresponding number of retainers 16.

Referring to FIGS. 7-10, as discussed above, the retainers 16 each preferably include an elastic body 26 that is preferably formed as a loop 28. By forming each retainer body 26 as a loop 28, one or more retainers 16 may engage with the rim 1 so that the two loop retainer portions 30 are disposed on opposing sides of, or "straddle", one of the conventional net hooks (none shown) used to connect a net (not shown) to the rim 1. Such straddling engagement of the loop retainer portions 30 provides an additional means of preventing horizontal movement of the supports 14 on the rim upper surface 1*a*. Further, for a practice device 10 intended to be used with a rim 1 having a bracer plate 5, two of the supports 14 will preferably be located generally above the bracer plate 5 when disposed upon the rim upper surface 1*a*. These two supports 14 are each provided with a retainer 16 having an unstretched body length that is relatively greater (i.e., longer) than the length of the retainer(s) 16 connected with the other support(s) 14, such additional length facilitating extension of each loop 28 around a portion of the bracer plate 5. As such, the loop retainer portions 30 of each of these retainer loops 28 are disposed about or around both the bracer plate 5 and the attached rim portion 2, as depicted in FIGS. 2 and 4.

Preferably, each retainer body loop 28 is formed of a length of cord 60 having sections that provide the four loop connective portions 29 disposable within the openings 56 and the two loop retainer sections 30. The cord 60 is preferably wrapped in at least one coil 62 about the central section 52*b* of the plate first portion 52 (i.e., between the openings 56) and has two ends 61 that are preferably tied into a knot 64, to thereby attach the retainer first end 16*a* to the support 14. However, the cord ends 61 may be otherwise attached together to form the loop 28, such as by a collar 63 (FIG. 8), by splicing or banding, by another fastening element (e.g., clamp, clip), etc. Prior to securing the cord 60 to the support 14, the grip member 32 is preferably connected with the retainer 16 by threading a section of the cord 60 through the disk central opening 34, as described in greater detail below.

Further, the elastic body 26 is preferably formed of either natural rubber and synthetic rubber, and most preferably as a bundle of elongated rubber strands covered by a cloth sheath. However, the preferred rubber material may be provided in another appropriate form, such as a single band, strand or bar, or the retainer body 26 may be provided by any other appropriate material, such as for example, spring steel.

Figure 9:
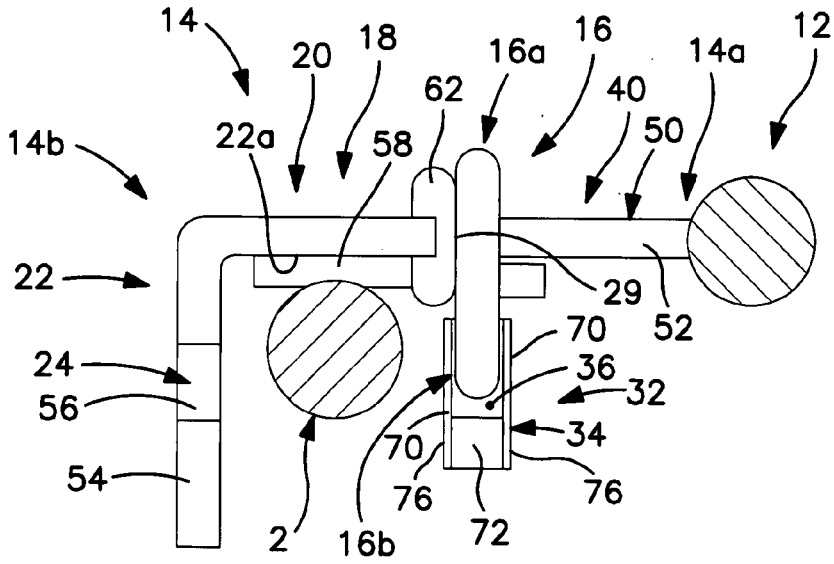
FIG. 9 is an enlarged, side view of a support and retainer, showing a retainer in an non-engaged configuration.
Figure 10:
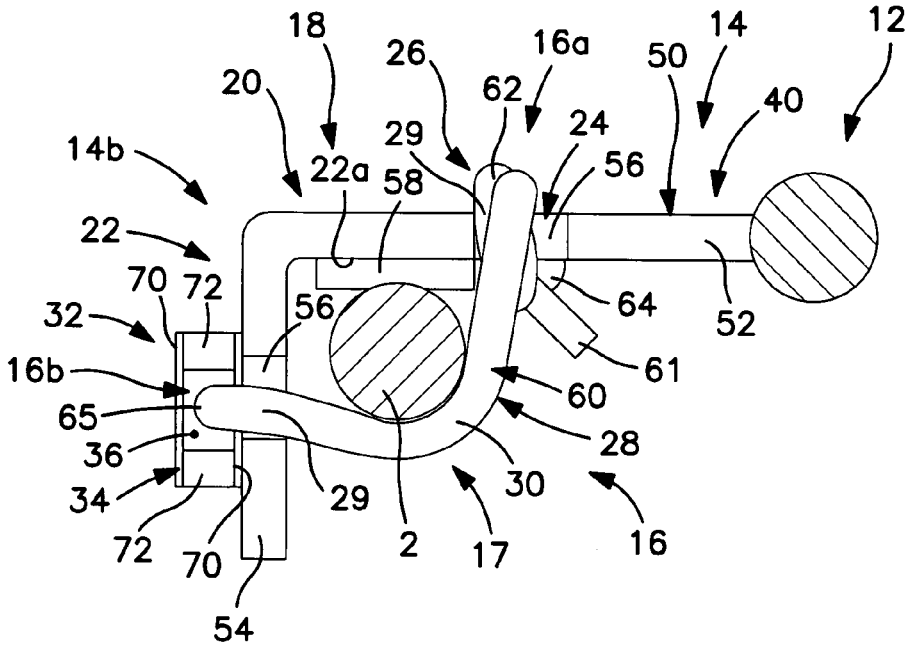
FIG. 10 is another view the support and retainer of FIG. 9, showing the retainer in an engaged configuration.

Referring to FIGS. 7-10, with the retainer structure as described above, when not in use to secure the device 10, the first end 16*a* of each retainer 16 is connected with the associated support 14 while the second end 16*b* is generally free or unsecured. When the practice device 10 is placed upon the rim 1, the support mount second section 24 and the retainer loop 28 each extend generally vertically on opposing sides of the proximal rim portion 2, as best shown in FIG. 9. Then, the retainer second end 16*b* is engaged with the support 14 by extending or pulling the elastic body 26 until the second end 16*b* engages the mount second section 24, which may also require extension around a portion of the rim bracer plate 5 prior to connecting with the second section 24, as discussed above. When so engaged, a securement portion 65 of the loop 28 extends across the outer surface 24*a* of the mount second section 24 and the two connective portions 29 are each disposed in a separate opening 56, while the loop retainer sections 30 extend about the rim portion 2 (and possibly also about a bracer plate 5). As such, the rim portion 2 is retained between support mount 18 and the retainer central section 17 to thereby securely mount the practice device 10 to the rim 1.

Furthermore, when it is desired to remove or demount the practice device 10 from the rim 1, each retainer 16 is extended to remove the securement loop portion 65 from the mount outer surface 24*a* and the loop connective portions 29 from the second mount openings 56. Then, the retainer 16 is released such that the elastic loop 28 returns to the free, unextended ("unstretched") state as depicted in FIG. 9. The support mounts 18 may then be lifted off of the rim upper surface 1*a* to remove the practice device 10 from the rim 1.

Although the retainers 16 are each formed as an elastic loop 28 as discussed above, the retainers 16 may each be formed in any other appropriate structure having two ends 16*a*, 16*b* engageable with the associated support 14 to retain a rim portion 2 therebetween. For example, the retainers 16 may each be formed as a "straight" length (i.e., non-looped) of elastic cord or rope (not shown) having one end attached to the mount first section 20 and a second, free end engageable with the mount second section 22 by any appropriate means. Further for example, the retainers 16 may each be formed a rigid bar or plate (none shown) having one end hingedly or pivotally attached to one of the mount sections 20 or 22 and a second end releasably engageable with the other mount section 22, 20. The scope of the present invention encompasses these and all other retainer structures capable of functioning generally as described herein.

Referring again to FIGS. 7-10, each grip body 34 is preferably formed of two parallel, generally circular disks 70 and two connective block portions 72 disposed between and connecting the disks 70. The central opening 36 is defined between the two blocks 72, extends diametrically across the length of the body 34, and is sized to receive a portion of the retainer 16, preferably a section of the cord 60. As such, the grip member 32 provides two opposing grip surfaces 76 graspable by a user to facilitate extension of the retainer body 26. However, as discussed above, the retainers 16 may be formed without a member or similar device.

Preferably, each annular body 12 is formed of a steel bar formed into a circle and having the ends welded together. Each support 14 is preferably formed of a plate of cold rolled steel with the slotted openings formed therein (e.g., by stamping) and having the inner ends 14*a* attached to the body 12 by welding. Further, as discussed above, each retainer 16 is preferably formed of rubber strands encased in a cloth sheath and each grip member 30 is formed of a molded polymeric material. However, any or all of the components of the practice device 10 may be formed of any appropriate material, such as forming the body 12 and supports as a molded polymeric material, and the scope of the present invention is in no manner limited to any particular materials.

Referring to FIGS. 1-4, when it is desired to use either the shot ring 11A or the rebound ring 11B, a user places the particular practice device 10 upon the rim 1 such that the supports 14 rest upon the rim upper surface 1*a*. As such, each support mount 18 is disposed upon a separate rim portion 2. The user then connects each support 14 to the proximal rim portion 2 merely by pulling or extending the associated retain 16 to engage the retainer second end 16*b* with the support 14, such that the rim portion 2 is retained between the mount 18 and retainer central section 17. After use, the practice device 14 may be removed or demounted from the rim 1 merely by grasping each retainer 16 and pulling the retainer second end 16*b* out of engagement with the associated support 14, enabling the practice device 10 to be lifted from the rim 1. Thus, the practice device 10 of the present invention may be quickly and easily connected with, and alternatively disconnected from, a conventional basketball rim 1 without the use of any tools. Such rapid installation and removal was not possible with previous practice device designs, which typically utilized one or more threaded fasteners to clamp the device to a rim 1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A basketball practice device for use with a basketball rim, the practice device comprising:

an annular body;

a support connected with the annular body and having a mount disposeable upon a portion of the rim; and a retainer having first end connected with the support, a second end releasably connected with the support, and a central section disposed between the first and second ends and extendable at least partially about the rim portion such that the rim portion is retained generally between the support mount and the retainer central portion to connect the practice device with the rim.

2. The practice device as recited in claim 1 wherein the rim has a diameter and the annular body has a diameter, the annular body diameter being substantially lesser than the rim diameter.

3. The practice device as recited in claim 1 wherein:

the rim has an upper surface and an outer circumferential surface; and the support mount has a first section disposeable upon the rim upper surface and a second section extending generally perpendicularly with respect to the first section and disposeable generally along the rim outer circumferential surface.

4. The practice device as recited in claim 3 wherein each of the two support mount sections has an opening configured to receive a separate one of the retainer first and second ends.

5. The practice device as recited in claim 3 wherein the support includes an angled plate with a first portion attached to the rim and providing the mount first section and a second portion integrally formed with the first portion and providing the mount second section.

6. The practice device as recited in claim 5 wherein each one of the plate first and second portions has two opposing side edges and two slotted openings each extending into the plate portion from a separate one of the two side edges, the two slotted openings of each plate portion being configured to receive a separate one of the retainer first and second ends so as to releasably connect the retainer with the support.

7. The practice device as recited in claim 6 wherein the retainer includes a flexible loop, each pair of slotted openings being configured to receive a separate portion of the loop.

8. The practice device as recited in claim 5 where in the plate first portion has at least one opening configured to receive the first end of the retainer and the plate second portion has two opposing side edges and two slotted openings each extending into the second plate portion from a separate one of the two side edges, the two slotted openings being configured to receive the retainer second end so as to releasably connect the retainer with the support.

9. The practice device as recited in claim 1 wherein when the retainer extends about the rim portion, the retainer central portion one of contacts the rim portion and is spaced from the rim portion.

10. The practice device as recited in claim 1 wherein the retainer first end is releasably connected with the support.

11. The practice device as recited in claim 1 wherein the retainer includes a generally elastic body providing the retainer first and second ends and the retainer central portion.

12. The practice device as recited in claim 11 wherein the elastic body is formed as a generally enclosed loop.

13. The practice device as recited in claim 11 wherein the retainer elastic body is configured to extend to engage the retainer second end with the support and alternatively to disengage the retainer second end from the support.

14. The practice device as recited in claim 13 wherein the retainer further includes a grip member connected with the elastic body and configured to be grasped by a user for manual extension of the body.

15. The practice device as recited in claim 1 further comprising at least one other support spaced circumferentially from the support and connected with the annular body.

16. The practice device as recited in claim 1 wherein the support includes an angled body with an inner portion attached to the rim and an outer portion extending generally perpendicularly with respect to the inner portion and disposeable upon the rim such that the annular body is spaced generally vertically above the rim.

17. The practice device as recited in claim 1 wherein the annular body is generally centered within the rim when the support mount is connected with the rim portion.

* * * * *